United States Patent [19]

Cullinan et al.

[11] Patent Number: 4,975,356

[45] Date of Patent: Dec. 4, 1990

[54] BLEACH-ACCELERATING COMPOSITIONS CONTAINING A DYE-STABILIZING AGENT AND USE THEREOF IN PHOTOGRAPHIC COLOR PROCESSING

[75] Inventors: Ann M. Cullinan, Henrietta; Paul A. Schwartz, Webster, both of N.Y.

[73] Assignee: Eastman Kodak Company, Rochester, N.Y.

[21] Appl. No.: 442,753

[22] Filed: Nov. 29, 1989

Related U.S. Application Data

[62] Division of Ser. No. 286,005, Dec. 19, 1988, Pat. No. 4,921,779.

[51] Int. Cl.[5] ..... G03C 5/38; G03C 5/39; G03C 5/44

[52] U.S. Cl. ..... 430/393; 430/427; 430/428; 430/430; 430/461; 252/94; 252/186.1; 134/2

[58] Field of Search ..... 430/372, 379, 393, 430, 430/461, 427, 428; 252/94, 186.1; 134/2

[56] References Cited

U.S. PATENT DOCUMENTS

| | | | |
|---|---|---|---|
| 3,667,950 | 6/1972 | Amano et al. | 96/60 |
| 3,879,202 | 4/1975 | Yamaguchi | 96/22 |
| 3,893,858 | 7/1975 | Wabnitz | 96/60 |
| 3,948,659 | 4/1976 | Yamaguchi et al. | 96/60 |
| 4,033,771 | 7/1977 | Borton et al. | 96/60 |
| 4,124,398 | 11/1978 | Ciurca et al. | 96/114.1 |
| 4,125,402 | 11/1978 | Mollet | 96/53 |
| 4,293,639 | 10/1981 | Itoh et al. | 430/393 |
| 4,506,007 | 3/1985 | Nakajima et al. | 430/393 |
| 4,554,242 | 11/1985 | Ohno et al. | 430/393 |
| 4,786,583 | 11/1988 | Schwartz | 430/372 |
| 4,839,262 | 6/1989 | Schwartz | 430/379 |

OTHER PUBLICATIONS

"Conditioning Baths for use in Photographic Processing", M. R. Murray et al., Research Disclosure, Item 19104, Mar., 1980.

"Stabilized Bleach Accelerator Baths for use in Photographic Processing", C. R. Cappel et al., Research Disclosure, Item 20111, Jan., 1981.

*Primary Examiner*—Paul R. Michl
*Assistant Examiner*—Patrick A. Doody
*Attorney, Agent, or Firm*—Alfred P. Lorenzo

[57] ABSTRACT

Improved bleach-accelerating compositions that are especially useful in the reversal color processing of photographic elements are comprised of a bleach-accelerating agent and a dye-stabilizing agent. Formaldehyde precursors function as particularly effective dye-stabilizing agents in such compositions. The bleach-accelerating composition is utilized subsequent to the color developing step and prior to the bleaching step and serves to enhance the effectiveness of the bleaching step and to provide improved dye stability.

4 Claims, No Drawings

BLEACH-ACCELERATING COMPOSITIONS CONTAINING A DYE-STABILIZING AGENT AND USE THEREOF IN PHOTOGRAPHIC COLOR PROCESSING

This is a divisional of application Ser. No. 286,005, filed Dec. 19, 1988, U.S. Pat. No. 4,921,779.

FIELD OF THE INVENTION

This invention relates in general to color photography and in particular to methods and compositions for use in the processing of color reversal photographic elements. More specifically, this invention relates to an improved bleach-accelerating composition for use in photographic color reversal processing, which provides effective acceleration of bleaching activity while also providing enhanced dye stability.

BACKGROUND OF THE INVENTION

Multicolor, multilayer photographic elements are well known in the art of color photography. Usually, these photographic elements have three different selectively sensitized silver halide emulsion layers coated on one side of a single support. The vehicle used for these emulsion layers is normally a hydrophilic colloid, such as gelatin. One emulsion layer is blue-sensitive, another green-sensitive and another red-sensitive. Although these layers can be arranged on a support in any order, they are most commonly arranged with the support coated in succession with the red-sensitized layer, the green-sensitized layer and the blue-sensitized layer (advantageously with a bleachable blue light-absorbing filter layer between the blue-sensitive layer and the green-sensitive layer) or with the opposite arrangement and no filter layer. Colored photographic images are formed from latent images in the silver halide emulsion layers during color development by the coupling of oxidized aromatic primary amine color developing agent with couplers present either in the color developer solution or incorporated in the appropriate light-sensitive layers. Color photographic elements containing dye images usually utilize a phenolic or naphtholic coupler that forms a cyan dye in the red-sensitized emulsion layer, a pyrazolone or cyanoacetyl derivative coupler that forms a magenta dye in the green-sensitized emulsion layer and an acetylamide coupler that forms a yellow dye in the blue-sensitive emulsion layer. Diffusible couplers are used in color developer solutions. Nondiffusing couplers are incorporated in photographic emulsion layers. When the dye image formed is to be used in situ, couplers are selected which form non-diffusing dyes. For image transfer color processes, couplers are used which will produce diffusible dyes capable of being mordanted or fixed in the receiving sheet.

In the production of color photographic images, it is necessary to remove the silver image which is formed coincident with the dye image. This can be done by oxidizing the silver by means of a suitable oxidizing agent, commonly referred to as a bleaching agent, in the presence of halide ion; followed by dissolving the silver halide so formed in a silver halide solvent, commonly referred to as a fixing agent. Alternatively, the bleaching agent and fixing agent can be combined in a bleach-fixing solution and the silver removed in one step by use of such solution.

A commercially important process intended for use with color reversal photographic elements which contain the couplers in the silver halide emulsion layers, or in layers contiguous thereto, utilizes, in order, the following processing baths: first developer, wash, reversal bath, color developer, bleach, fix, wash and stabilizer. In this process, the first developer reduces the exposed silver halide to metallic silver; the reversal bath nucleates the silver halide that remains after first development, the color developer converts the nucleated silver halide to metallic silver and forms the dye images, the bleach coverts all metallic silver to silver halide, the fix converts the silver halide into soluble silver complexes that are washed from the element, and the stabilizing bath improves image dye stability.

In one particularly advantageous form of the aforesaid color reversal process, a bleach-accelerating bath is employed between the color developing bath and the bleaching bath. Such a bleach-accelerating bath is also referred to in the photographic field as a "conditioning bath". It is used to "condition" the metallic silver, developed in the first and color developers, for complete oxidation to silver halide and to help preserve the acidity of the bleach solution by reducing carryover of color developer into the bleach. The conditioning bath contains, as an essential ingredient, an effective amount of a bleach-accelerating agent. This agent is imbibed into the emulsion layers of the photographic element during treatment with the conditioning bath and, accordingly, is present to exert its beneficial influence in situ when the photographic element enters the subsequent bleach bath.

A wide variety of effective bleach-accelerating agents are well known in the art of photographic color processing. Examples of particularly effective bleach-accelerating agents include aliphatic thiols, heretocyclic thiols, disulfides, thioethers, and persulfates. References describing specific agents which exhibit very effective bleach-accelerating capabilities include British Pat. No. 1,138,842 published Jan. 1, 1969 and U.S. Pat. No. 3,893,858 issued July 8, 1975.

It is well known in the photographic art to utilize a stabilizing bath as the final step in the processing of both color films and color papers. Such baths can serve to reduce stain and/or enhance dye stability. A wide variety of different stabilizing compositions have been proposed for such use. Thus, the known stabilizing baths include those containing thiourea or a substituted thiourea as described in Kellog, U.S. Pat. No. 2,487,446 issued Nov. 8, 1949; aliphatic aldehydes as described in Harsh et al, U.S. Pat. No. 2,518,686 issued Aug. 15, 1950; addition products of formaldehyde and a urea, as described in Mackey, U.S. Pat. No. 2,579,435 issued Dec. 18, 1951; tetramethylol cyclic alcohols or ketones as described in Clarke et al, U.S. Pat. No. 2,983,607 issued May 9, 1961; glucoheptonates as described in Bard, U.S. Pat. No. 3,157,504 issued Nov. 17, 1964; carbohydrazides as described in Larson, U.S. Pat. No. 3,201,244, issued Aug. 17, 1965; amino acids as described in Jeffreys, U.S. Pat. No. 3,291,606 issued Dec. 13, 1966; mixtures of an aldehyde and an alkoxy-substituted polyoxyethylene compound as described in Seemann et al, U.S. Pat. No. 3,369,896 issued Feb. 20, 1968; compounds comprising a tri(hydroxymethyl)-methyl group as described in Jeffreys et al, U.S. Pat. No. 3,473,929 issued Oct. 21, 1969; and addition complexes of an alkali metal bisulfite and an aldehyde as described in Mowrey, U.S. Pat. No. 3,676,136 issued July 11, 1972. The use of more than one active agent in such stabilizing baths is also known. For example, U.S. Pat. No. 3,676,136 to Mowrey describes the use of antioxidants such as glucose, galactose, sorbitol or mannitol in a stabilizing bath in addition to an aldehyde bisulfite addition complex.

Magenta dye stability is a particularly serious problem in color photography, as the magenta dye image tends to fade much more rapidly than either the cyan dye image or the yellow dye image. The dark-keeping stability of magenta image dyes derived from pyrazolone couplers is adversely affected by the presence of the coupler itself. This is particularly evident in the toe and midscale regions of the green sensitometric curve. In these areas, there is a substantial amount of the unreacted coupler. This unreacted coupler undergoes complex chemical reactions with the magenta dye.

For many years, formaldehyde has been commonly used as a stabilizing agent in photographic color processing to provide enhanced magenta dye stability. The photographic element is treated with a final bath—called a "stabilizing bath"—that contains formaldehyde. The formaldehyde reacts with the unused coupler in the film, forming a stable compound that will not react with the magenta dye. Under normal processing conditions, this reaction is completed in the drying oven. However, while formaldehyde is a very effective stabilizing agent for this purpose, its use is highly disadvantageous from an ecological standpoint because of the well known ecological concerns relating to formaldehyde.

It is toward the objective of providing an improved bleach-accelerating composition which does an effective job of accelerating the bleaching action of the subsequently utilized bleaching agent, and which provides improved dye stability so as to eliminate the need for a stabilizing bath, that the present invention is directed.

SUMMARY OF THE INVENTION

In accordance with this invention, it has been discovered that formaldehyde precursors can be incorporated in bleach-accelerating compositions to provide enhanced dye stability and thereby eliminate the need for a stabilizing bath containing formaldehyde. Thus, the improved bleach-accelerating compositions of this invention, which are especially useful in color reversal photographic processing, are comprised of an effective amount of a bleach-accelerating agent and a sufficient amount of a formaldehyde precursor to provide effective dye-stabilizing action.

The present invention also provides an improved method of photographic processing including the steps of treating a photographic element, in succession, with a color developing composition, a bleach-accelerating composition, and a bleaching composition in which the bleach-accelerating composition comprises a bleach-accelerating agent and a dye-stabilizing amount of a formaldehyde precursor.

DESCRIPTION OF THE PREFERRED EMBODIMENTS

Any of a wide variety of photographic elements can be advantageously processed with the aid of the improved bleach-accelerating compositions of this invention. For a detailed description of useful photographic elements and methods for their manufacture, reference can be made to Research Disclosure, Item 17643, Vol. 176, December, 1978, published by Industrial Opportunities Ltd., Havant Hampshire, P091EF, United Kingdom.

Color reversal photographic elements utilized in the practice of this invention are comprised of a support having on one side thereof a plurality of photosensitive silver halide emulsion layers. The photosensitive layers can contain any of the conventional silver halides as the photosensitive material, for example, silver chloride, silver bromide, silver bromoiodide, silver chlorobromide, silver choroiodide, silver chlorobromoiodide, and mixtures thereof. Useful support materials include cellulose acetate film, polyvinylacetal film, polycarbonate film, polystyrene film, polyethylene terephthalate film, and the like. The silver halide is dispersed within a suitable hydrophilic colloid such as gelatin or derivatives thereof. The silver halide emulsion layers can contain a variety of well known addenda, including such agents as chemical sensitizers, development modifiers, antifoggants, and the like.

As explained hereinabove, a well known color reversal process of the prior art utilizes a first developer, a reversal bath, a color developer, a bleach-accelerating bath, a bleach bath, a fix and a stabilizer. The components that are useful in each of such baths are well known in the photographic art. The improved process of this invention utilizes the same baths except that the stabilizer is not needed, i.e., the final bath can be a rinse or wash bath consisting of water, or preferably an aqueous solution containing a sufficient amount of a surfactant to prevent spotting of the photographic film.

The first developer contains a black-and-white developing agent or a mixture of such developing agents. Useful developing agents include dihydroxybenzene developing agents such as hydroquinone, 3-pyrazolidone developing agents such as 1-phenyl-3-pyrazolidone, and aminophenol developing agents such as para-aminophenol. In addition to the developing agent, the first developer typically contains other agents such as preservatives, sequestering agents, restrainers, antifoggants, buffers and silver halide solvents.

The reversal bath contains a nucleating agent, usually a boron compound or a chelated stannous salt that functions as a reducing agent, as well as antioxidants, buffers, fungicides and sequestering agents.

In addition to an aromatic primary amino color developing agent, the color developing bath typically contains sequestering agents, buffering agents, preservatives, competing couplers and silver halide solvents.

Particularly useful aromatic primary amino color developing agents are the p-phenylenediamines and especially the N,N-dialkyl-p-phenylenediamines in which the alkyl groups or the aromatic nucleus can be substituted or unsubstituted. Examples of useful p-phenylenediamine color developing agents include:

N,N-diethyl-p-phenylenediamine monohydrochloride,
4-N,N-diethyl-2-methylphenylenediamine monohydrochloride,
4-(N-ethyl-N-2-methanesulfonylaminoethyl)-2-methylphenylenediamine sesquisulfate monohydrate,
4-(N-ethyl-N-2-hydroxyethyl)-2-methylphenylenediamine sulfate,
4-N,N-diethyl-2,2'-methanesulfonylaminoethylphenylenediamine hydrochloride,
and the like.

The essential component of the bleaching bath is the bleaching agent which converts metallic silver to silver ions. Other common components of the bleaching bath include halides, sequestering agents and corrosion inhibitors. Ammonium or alkali metal salts of a ferric complex of an aminopolycarboxylic acid are particularly useful as bleaching agents. Also of particular utility are the persulfate bleaching agents such as ammonium persulfate or an alkali metal persulfate.

Bleaching agents can be used individually or in the form of mixtures of two or more bleaching agents. Exemplary bleaching agents of the aminopoly-carboxylic acid type, which can be used alone or in the form of mixtures, include ferric complexes of:
nitrilotriacetic acid,
ethylenediamine tetraacetic acid,
1,3-propylenediamine tetraacetic acid,
diethylenetriamine pentaacetic acid,
ortho-diamine cyclohexane tetraacetic acid,
ethylene glycol bis(aminoethyl ether) tetraacetic acid,
diaminopropanol tetraacetic acid,
N-(2-hydroxyethyl)ethylenediamine triacetic acid,
ethyliminodipropionic acid,
iminodiacetic acid,
methyliminodiacetic acid,
ethyliminodiacetic acid,
and the like.

The fixing bath converts all silver halide into soluble silver complexes which diffuse out of the emulsion layers. Fixing bath retained within the layers of the photographic element is removed in a subsequent water washing step. Thiosulfates, including ammonium thiosulfate and alkali metal thiosulfates such as sodium thiosulfate and potassium thiosulfate, are particularly useful as fixing agents. Other components of the fixing bath include preservatives and sequestering agents.

A wide variety of different color reversal processes are well known in the art. For example, a single color developing step can be used when the coupling agents are incorporated in the photographic element or three separate color developing steps can be used in which coupling agents are included in the developing solutions. The reversal step can be carried out by use of a reversal bath, or by a re-exposure step, or by incorporating a fogging agent in the color developing bath. In order to provide shorter processing times, bleaching and fixing can be combined in a single step.

The present invention is particularly concerned with enhancing dye stability through the use of an improved bleach-accelerating bath that contains a formaldehyde precursor. In addition to the bleach-accelerating agent and the formaldehyde precursor, the bleach-accelerating bath typically contains a preservative, for example, an alkali metal sulfite, and a sequestering agent, for example, ethylenediaminetetraacetic acid, which prevents the formation of iron stain in the emulsion layers. It may also contain an agent which alleviates the problem of scum formation.

The bleach-accelerating baths of this invention are aqueous acidic solutions typically having a pH in the range of from about 4.5 to about 6.5. They contain a bleach-accelerating agent, which is typically present in an amount of from about 0.1 to about 20 grams per liter of solution and more preferably in an amount of from about 0.4 to about 2 grams per liter. They also contain a formaldehyde precursor, which is typically present in an amount of from about 0.1 to about 20 grams per liter of solution and more preferably in an amount of from about 2 to about 10 grams per liter.

Sulfur-containing organic compounds are most frequently utilized as bleach-accelerating agents in photographic color processing. However, other types of bleach-accelerating agents are also known including the polyalkylene oxides of U.S. Pat. No. 3,241,966, the organic amines of U.S. Pat. No. 3,707,374, the onium compounds of U.S. Pat. No. 3,748,136 and the n-hexoxyethanol of U.S. Pat. No. 3,042,520. Patents describing the use of various sulfur-containing organic compounds as bleach-accelerating agents include U.S. Pat. No. 3,617,283, 3,772,020, 3,809,563, 3,893,858 and 4,144,068 and British Pat. No. 1 138 842 and 1 374 359. Use of a persulfate to accelerate the bleaching activity of a bleaching bath, containing a ferric complex of an aminopolycarboxylic acid as a bleaching agent, is described in Research Disclosure, Vol. 207, Item 20744, July 1981.

Use of thiols and of metal complexes such as the bipyridine complexes of cobalt, to accelerate the bleaching activity of persulfate bleaching agents is described in Research Disclosure, Vol 157, Item 15704, May, 1977. Use of a heavy metal sequestering agent to improve the stability of bleach-accelerating baths containing a thiol is described in Research Disclosure, Vol. 201, Item 20111, Jan., 1981.

Sulfur-containing organic compounds which are preferred for use as bleach-accelerating agents in this invention include heterocylic thiols such as aminothiadiazolethiol, mercaptotriazole, imidazolethiol and aminomercaptotriazole; disulfides such as bis(2-aminoethane)disulfide, thioglycerol disulfide and bis(N,N-dimethyl-2-aminoethane)disulfide; and thioethers such as dithiaoctanediol and thiadiethanol. Especially preferred are aliphatic thiols of the formula:

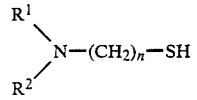

where each of $R^1$ and $R^2$ is H, $CH_3$ or $C_2H_5$ and n is an integer having a value of from 1 to 3. Specific examples of such aliphatic thiols include 2-aminoethanethiol, 3-aminopropanethiol, dimethylaminoethanethiol, N-methyl-N-ethyl-aminoethanethiol and diethylaminoethanethiol.

The most preferred bleach-accelerating agent for the purpose of this invention is monothioglycerol.

By the term "formaldehyde precursor", as used herein, is meant any compound capable of establishing, in the bleach-accelerating solution, an equilibrium relationship between it and formaldehyde. While applicants are not certain of the mechanism whereby their invention functions, it is believed that the precursor acts, in effect, as a formaldehyde donor which gradually releases formaldehyde into the solution at the same rate as it is used up in the dye-stabilizing reaction to thereby maintain the equilibrium relationship. Thus, the concentration of formaldehyde in the bleach-accelerating solution is always at a very low level and there is not enough formaldehyde in the solution to result in a build-up of undesirably high concentrations in the air above the solution.

Formaldehyde precursors which are especially useful for the purpose of this invention include the water-soluble N-methylol compounds. As used herein, the term "N-methylol compound" refers to a compound having at least one methylol group attached directly to a nitrogen atom. Particularly preferred for the purpose of this invention are N-methylol compounds represented by formulae I, II or III as follows:

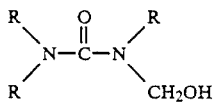

I.

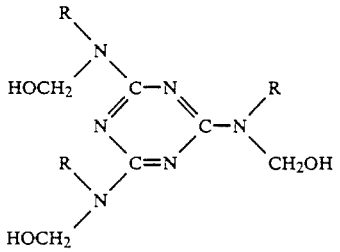

II.

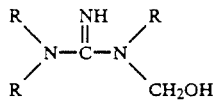

III.

wherein R is a hydrogen atom or a methylol group.

Illustrative examples of particularly preferred N-methylol compounds for the purpose of this invention include:

dimethylol urea
trimethylol urea
dimethylol guanidine
trimethylol melamine
tetramethylol melamine
pentamethylol melamine
hexamethylol melamine
and the like.

Yet another particularly preferred N-methylol compound is 1,3-dimethylol-5,5-dimethyl hydantoin.

In addition to the N-methylol compounds, examples of especially effective formaldehyde precursors include sodium formaldehyde bisulfite and hexamethylenetetramine.

In a preferred embodiment of this invention, the bleach-accelerating composition contains an ethyleneoxy-substituted fatty acid ester of sorbitan in an amount sufficient to prevent scum formation. As explained in copending commonly assigned U.S. patent application Ser. No. 162,437, entitled, "Bleach-Accelerating Compositions And Use Thereof In Photographic Color Processing", filed Mar. 1, 1988 in the name of Paul A. Schwartz now U.S. Pat. No. 4,839,262, issued June 13, 1989, a serious problem that is commonly encountered in the use of bleach-accelerating baths of the type described herein is the formation of scum on the photographic element. As disclosed in application Ser. No. 162,437, ethyleneoxy-substituted fatty acid esters of sorbitan are highly effective as scum preventing agents in such bleach-accelerating baths. They are usefully employed in amounts of from about 0.1 to about 20 grams per liter of solution and more preferably in amounts of from about 1 to about 3 grams per liter. The ethyleneoxy-substituted fatty acid esters of sorbitan are well known commercially available nonionic surfactants and are sold under the trademark TWEEN by ICI Americas Inc. Surfactants that are commercially available under this trademark include TWEEN 20, TWEEN 21, TWEEN 40, TWEEN 60, TWEEN 61, TWEEN 65, TWEEN 80, TWEEN 81 and TWEEN 85. These surfactants are also referred to as polysorbates.

The time and temperature for treatment of the photographic element with the bleach-accelerating bath of this invention can vary widely, as desired. Typically, temperatures in the range of from about 20° C. to about 40° C. and times in the range of from about 0.5 to about 5 minutes are suitable.

Incorporation of a formaldehyde precursor in a bleach bath is disclosed in copending commonly assigned U.S. patent application Ser. No. 286,111, filed Dec. 19, 1988, entitled "Bleaching Compositions Containing A Dye-Stabilizing Agent And Use Thereof In Photographic Color Processing", by A. M. Cullinan and P. A. Schwartz.

The invention is further illustrated by the following examples of its practice.

EXAMPLES 1–3

Three different bleach-accelerating baths within the scope of this invention were prepared as follows:

| | grams/liter |
|---|---|
| Bath A | |
| Monothioglycerol | 0.5 |
| Ethylenediaminetetraacetic acid | 8.0 |
| Potassium sulfite (45% aqueous solution) | 29.1 |
| Sodium formaldehyde bisulfite | 8.84 |
| TWEEN 20* | 2.0 |
| Water to one liter | |
| Bath B | |
| Monothioglycerol | 0.5 |
| Ethylenediaminetetraacetic acid | 8.0 |
| Potassium sulfite (45% aqueous solution) | 29.1 |
| Dimethylolurea | 7.92 |
| TWEEN 20 | 2.0 |
| Water to one liter | |
| Bath C | |
| Monothioglycerol | 0.5 |
| Ethylenediaminetetraacetic acid | 8.0 |
| Potassium Sulfite (45% aqueous solution) | 29.1 |
| Hexamethylenetetramine | 3.08 |
| TWEEN 20 | 2.0 |

*Trademark for polyoxyethylene 20 sorbitan monolaurate available commercially from ICI Americas Inc.

The above-described bleach-accelerating baths were evaluated in the processing of a conventional color reversal photographic film. This film contained a 1-aryl-5-pyrazolone magenta coupler of the formula:

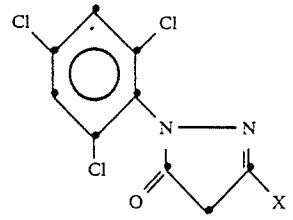

where X represents:

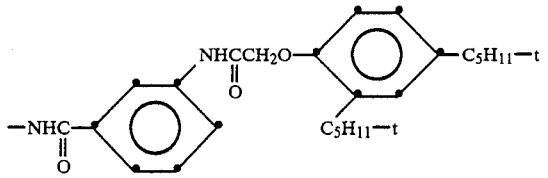

The 1-aryl-5-pyrazolone magenta couplers are believed to react with formaldehyde in accordance with the following equation:

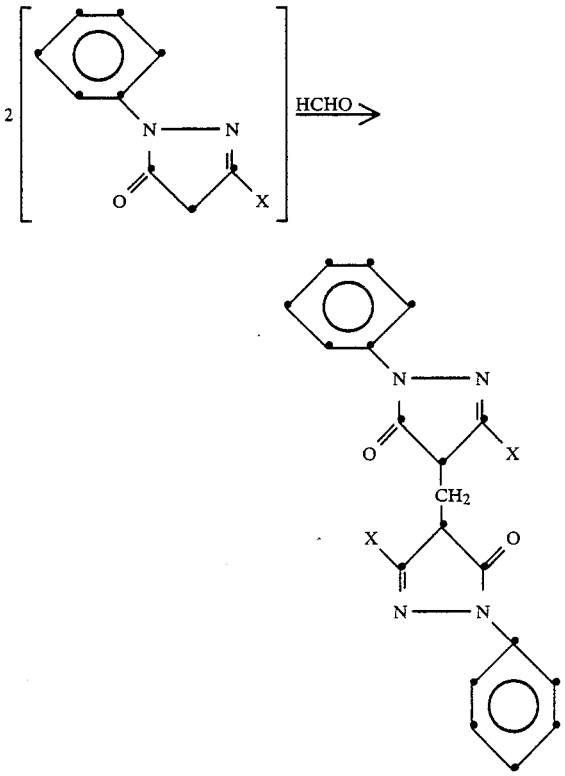

Reaction of the magenta coupler with formaldehyde prevents it from reacting with the magenta dye formed by color development.

The color reversal film was processed in Control Test 1 using a conventional color reversal process employing the following processing times:

| | |
|---|---|
| First Developer | 6 min. |
| Wash | 2 min. |
| Reversal Bath | 2 min. |
| Color Developer | 6 min. |
| Conditioner | 2 min. |
| Bleach | 6 min. |
| Fixer | 4 min. |
| Wash | 4 min. |
| Stabilizer | 30 sec. |
| Dry | @ 63° C. |

In this process, the stabilizing bath was an aqueous bath containing formaldehyde and a wetting agent.

In Control Test 2, the film was processed in the same manner described above except that the stabilizer was omitted. In each of examples 1 to 3, the stabilizer was omitted and the bleach-accelerating bath utilized was Bath A, Bath B and Bath C, respectively.

For Control Test 1, measurement was made of the amount of formaldehyde in the vapor in equilibrium with the stabilizer bath. For Examples 1 to 3, measurement was made of the amount of formaldehyde in the vapor in equilibrium with the bleach-accelerating bath. For each of Control Tests 1 and 2 and Examples 1 to 3, measurements were made of (1) the amount of residual unreacted magenta coupler in the film as measured by liquid chromatography and (2) the percentage change in green density at the 1.0 density level after three days at 77° C.

The results obtained are reported in Table I below:

TABLE I

| Test | % Unreacted Coupler | Percentage Change in Green Density | Formaldehyde in Vapor (μg/500 mL)* |
|---|---|---|---|
| Control Test 1 | 0 | −2 | 71.9 |
| Control Test 2 | 100 | −27 | — |
| Example 1 | 46 | −11 | <3.6 |
| Example 2 | 20 | −8 | <3.6 |
| Example 3 | 12 | −6 | <3.6 |

*3.6 μg/500 mL represents the detection limit.

As indicated by these data, in Control Test 1 the coupler reacted with formaldehyde so that no unreacted coupler remained and the dye stability was good, but there was an undesirably high concentration of formaldehyde in the vicinity of the processing equipment. When the stabilizing bath was omitted in Control Test 2, the result was freedom from objectionable formaldehyde vapor in the atmosphere but inadequate magenta dye stability. In each of examples 1 to 3, the presence of objectionable formaldehyde vapor was avoided, yet improvement in dye stability, as compared with Control Test 2, was achieved by use of the formaldehyde precursor in the bleach-accelerating bath.

The invention has been described in detail with particular reference to preferred embodiments thereof, but it will be understood that variations and modifications can be effected within the spirit and scope of the invention.

We claim:

1. A bleach-accelerating and dye-stabilizing composition that is useful in color reversal photographic processing to treat a silver halide color photographic element after the step of color development and prior to the step of bleaching and thereby increase bleaching rate and enhance dye stability, said composition comprising a bleach-accelerating agent and a dye-stabilizing amount of sodium formaldehyde bisulfite.

2. A bleach-accelerating composition as claimed in claim 1 wherein said bleach-accelerating agent is a sulfur-containing organic compound.

3. A bleach-accelerating composition as claimed in claim 1 wherein said bleach-accelerating agent is an aliphatic thiol.

4. A bleach-accelerating composition as claimed in claim 1 wherein said bleach-accelerating agent is monothioglycerol.

* * * * *